US009249635B2

(12) United States Patent
Ferrari

(10) Patent No.: US 9,249,635 B2
(45) Date of Patent: Feb. 2, 2016

(54) METHOD FOR AUTOMATIC HANDLING OF DRILLING RODS AND TUBULAR WELLBORE ELEMENTS, EXCAVATION EQUIPMENT AND ASSOCIATED COMPUTER PROGRAM

(75) Inventor: Stefano Ferrari, Barbiano (IT)

(73) Assignee: DRILLMEC S.P.A., Gariga di Podenzano (PC) (IT)

( * ) Notice: Subject to any disclaimer, the term of this patent is extended or adjusted under 35 U.S.C. 154(b) by 337 days.

(21) Appl. No.: 13/820,500

(22) PCT Filed: Aug. 24, 2011

(86) PCT No.: PCT/IB2011/001999

§ 371 (c)(1), (2), (4) Date: May 13, 2013

(87) PCT Pub. No.: WO2012/032384

PCT Pub. Date: Mar. 15, 2012

(65) Prior Publication Data

US 2013/0220601 A1 Aug. 29, 2013

(30) Foreign Application Priority Data

Sep. 6, 2010 (IT) ..... TO2010A0736

(51) Int. Cl.
*E21B 19/20* (2006.01)
*E21B 19/00* (2006.01)
*E21B 19/16* (2006.01)

(52) U.S. Cl.
CPC ..... *E21B 19/20* (2013.01); *E21B 19/00* (2013.01); *E21B 19/16* (2013.01)

(58) Field of Classification Search
USPC ..... 166/250.01, 53, 380
See application file for complete search history.

(56) References Cited

U.S. PATENT DOCUMENTS

| | | | | |
|---|---|---|---|---|
| 3,143,220 | A * | 8/1964 | Goepfert | 414/22.53 |
| 4,042,123 | A | 8/1977 | Sheldon et al. | |
| 4,604,724 | A | 8/1986 | Shaginian et al. | |
| 4,725,179 | A | 2/1988 | Woolslayer et al. | |
| 6,186,248 | B1 | 2/2001 | Silay et al. | |
| 2004/0140159 | A1 * | 7/2004 | Belik | 184/14 |
| 2008/0110637 | A1 * | 5/2008 | Snider et al. | 166/380 |
| 2010/0135750 | A1 | 6/2010 | Tarique | |

OTHER PUBLICATIONS

International Search Report for PCT/IB2011/001999 mailed Dec. 5, 2011 (3 pgs.).

* cited by examiner

*Primary Examiner* — Taras P Bemko
(74) *Attorney, Agent, or Firm* — Merchant & Gould P.C.

(57) ABSTRACT

A method for automatic handling of drilling rods includes a step of handling at least one drilling rod (30) by a handler (40) designed for simultaneously clamping and moving the drilling rod (30), and wherein the handler (40) moves the drilling rod (30) from an auxiliary retainer (200) to a main well (100). The handling step takes place automatically and is controlled by a data processing unit, and includes automatic handling of a drill head (20) fitted with a chuck susceptible to being screwed to the drilling rod (30); the automatic handling occurring among a plurality of heights (q1-q6) stored in the data processing unit.

14 Claims, 6 Drawing Sheets

METHOD FOR AUTOMATIC HANDLING OF DRILLING RODS AND TUBULAR WELLBORE ELEMENTS, EXCAVATION EQUIPMENT AND ASSOCIATED COMPUTER PROGRAM

This application is a National Stage Application of PCT/IB2011/001999, filed 24 Aug. 2011, which claims benefit of Serial No. TO2010A000736, filed 6 Sep. 2010 in Italy and which application(s) are incorporated herein by reference. To the extent appropriate, a claim of priority is made to each of the above disclosed applications.

BACKGROUND OF THE INVENTION

The present invention relates to a method for handling drilling rods and tubular wellbore casing elements; more in detail, it relates to a method for automatic handling of drilling rods and tubular wellbore casing elements, to the excavation equipment thereof, and to the computer program associated therewith.

It is known that traditional drilling machines use drilling rods which are driven in series one after the other into a main well.

It is also known that traditional drilling machines are installed with a drilling head above a main well, which is flanked by a service well, known in the art as mouse hole, into which the drilling rods, after having been picked up by a rod handler from a drilling rod container, are temporarily stored waiting for being picked up by the machine's drilling head, which then translates again over the main well with the rod just picked up from the mouse hole.

Traditionally, the process of picking up from the service hole the rods to be subsequently driven into the series of rods in the main well is carried out through manual steps which require the attention of an operator at the machine's controls, as well as the presence of an assistant on the drill floor, who does the work of manually greasing the threads of the drilling rods and of guiding the rods during the initial screwing step.

These manual operations are not exempt from troubles and dangers. In fact, mistakes may be made by the operator at the machine's controls due to lack of attention, which mistakes may lead to malfunctions or may cause dangerous situations to arise for the assistant on the drill floor. Moreover, the manually greased threads may suffer from excess of or unevenly distributed grease. In both cases, problems may arise at the threaded connections between the drilling rods.

Document U.S. Pat. No. 4,042,123 discloses a method for automatic handling of drilling rods from an auxiliary retaining means to a main well by means of a handling system. However, U.S. Pat. No. 4,042,123 does not teach any steps of picking up drilling rods through a drill head, also known as "top drive".

In the event of an explosion or uncontrolled leakage of fluids and gases (also known as "blow-out"), there is a concrete risk that the outflow of fluids and gases from the last rod at the top of the well cannot be controlled.

SUMMARY OF THE INVENTION

It is therefore the object of the present invention to describe a method for automatic handling of drilling rods and tubular wellbore casing elements which is free from the above-described drawbacks.

According to the present invention, a method for automatic handling of drilling rods and tubular wellbore casing elements is provided.

The present invention also provides a memory medium comprising portions of software code which can be loaded into the memory of a data processor for executing a method for automatic handling of drilling rods and tubular wellbore casing elements.

According to the present invention, excavation equipment is also provided.

BRIEF DESCRIPTION OF THE DRAWINGS

The invention will now be described with reference to the annexed drawings showing a non-limiting embodiment thereof, wherein.

DETAILED DESCRIPTION OF THE PREFERRED EMBODIMENTS

Figure 1:
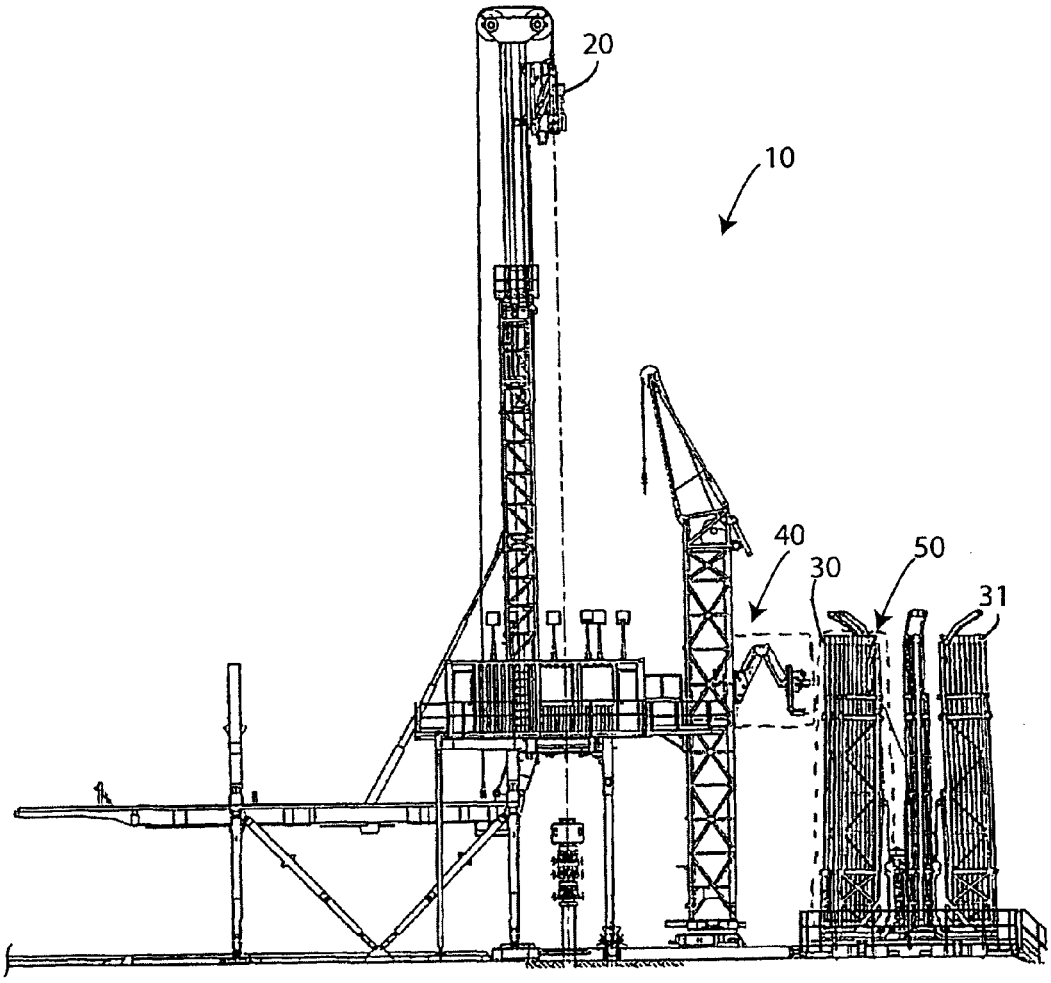
FIG. 1 shows a global view of a drilling machine comprising a handler of drilling rods and tubular wellbore casing elements and operating in accordance with the method described in the present invention.
Figure 2:
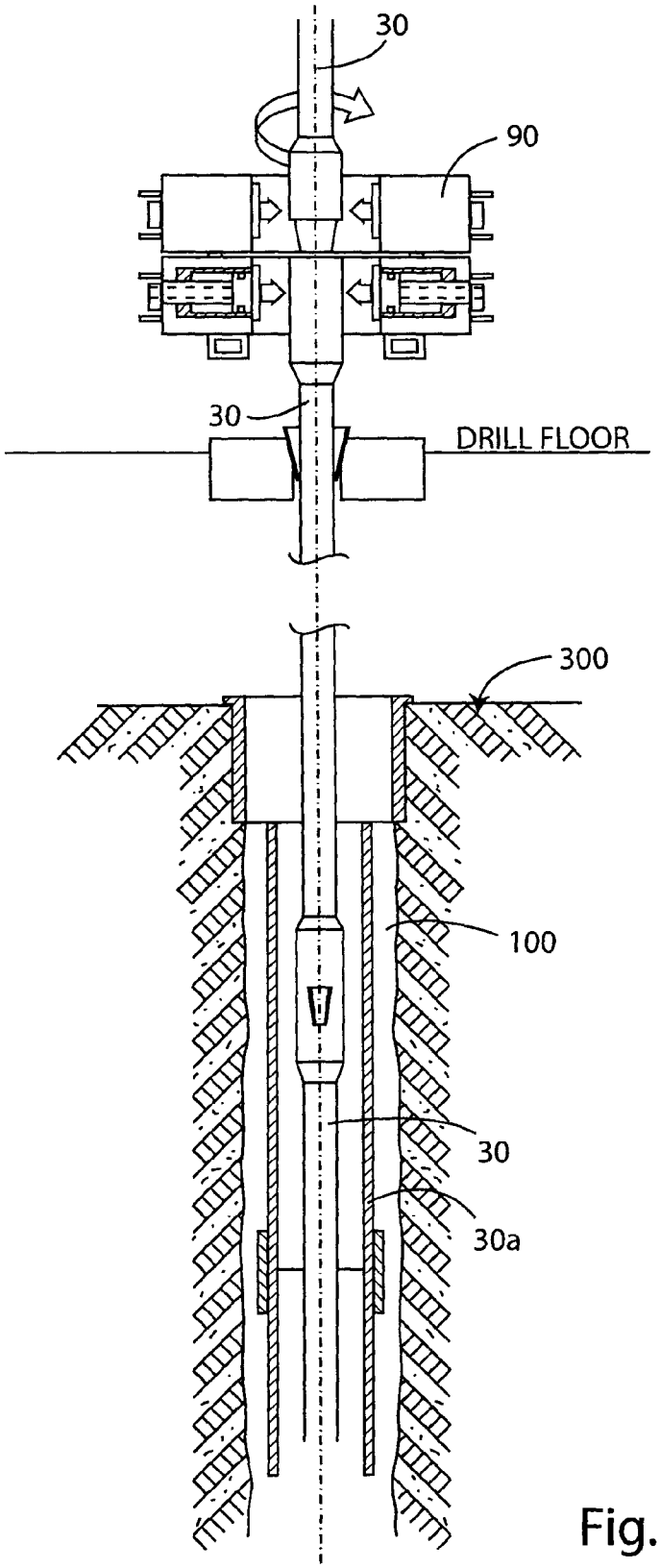
FIG. 2 shows a detail of a portion of FIG. 1.
Figure 3:
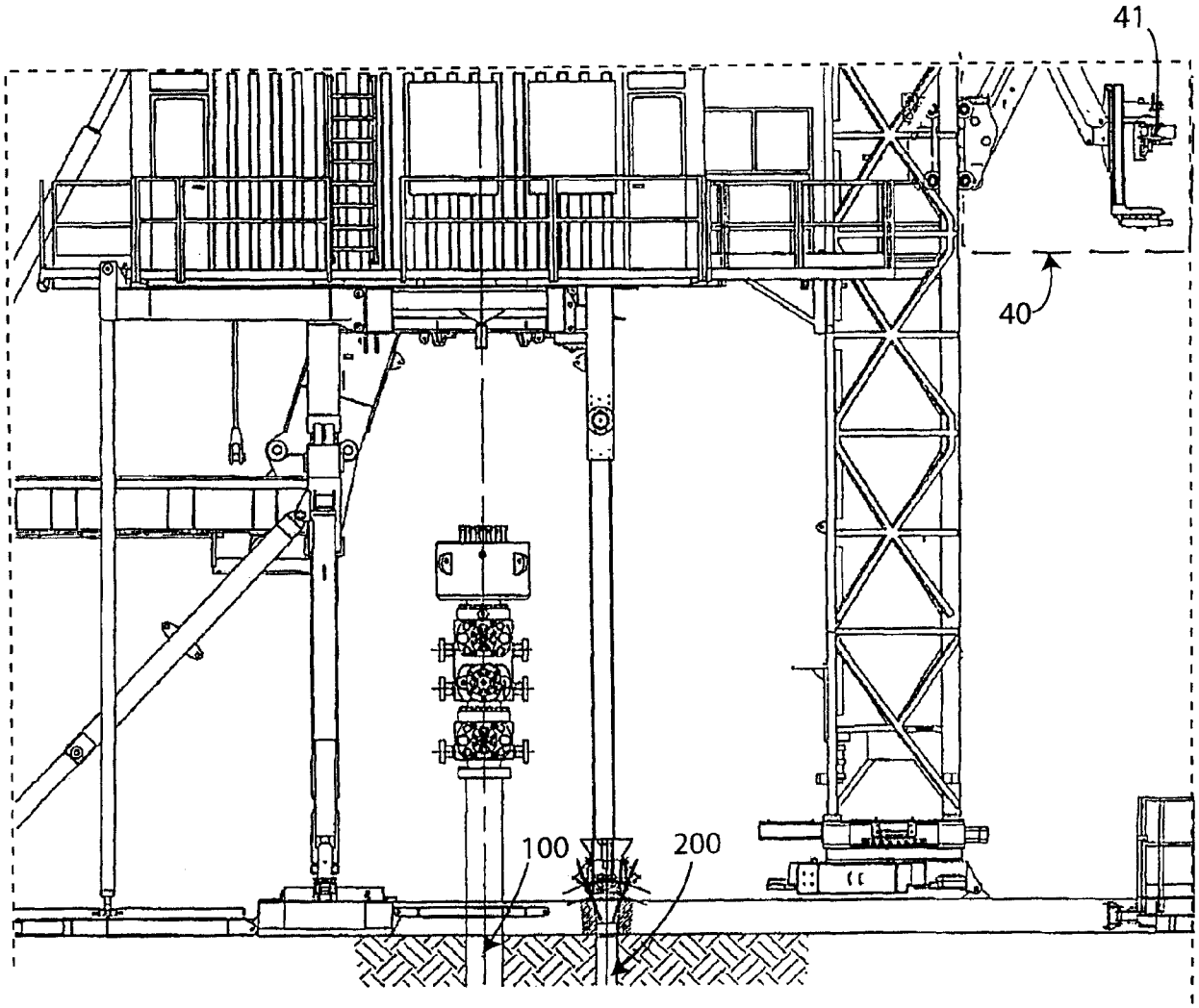
FIG. 3 shows a detail of the machine of FIG. 1.

With reference to FIGS. 1, 2, reference numeral 10 designates as a whole a device for automatic handling of drilling rods and tubular wellbore casing elements.

The automatic handling method that will be described hereafter comprises two main sub-methods:

- a first sub-method of picking up drilling rods from a drilling rod container for placing them into a main well; and
- a second sub-method of picking up drilling rods from the main well for placing them into a container.

The method described below is carried out automatically by a drilling machine 10 having a mobile drill head 20 (top-drive) capable of moving from a main well 100 to a secondary well 200, where a drilling rod 30 is temporarily stored.

Likewise, the mobile drill head 20 may comprise a tool capable of removably constraining itself to a tubular wellbore casing element 30*a*, which is driven into and coats wellbore 300, thus separating drilling rods 30 from the surrounding earth. Tubular element 30*a* is known in the art as casing, and is first lowered into main well 100 and then cemented therein. At the boundary with ground level 300, a blow-out preventer 90 (BOP) is mounted onto casings 30*a* to stop any uncontrolled outflow of fluids or gases from the bottom of main well 100 (FIG. 2).

In main well 100, drilling rods 30 are arranged in series, suspended from movable support wedges. Likewise, casings 30*a* are arranged in series in the main well.

Drilling machine 10 further comprises power clamps 90, which allow drilling rods 30 or casings 30*a* to be fastened together; in fact, each rod is fitted with a head 31 with a female thread and a foot 32 with a male thread which can be connected to each other; although drilling head 20 has a rotary chuck capable of screwing a rod connected thereto into another rod, it is also true that the final tightening cannot be done starting from drill head 20 due to the limited torque exerted by the chuck. For this very reason, power clamps 90 allow opening and closing the engagement between one drilling rod and another drilling rod by applying a torque T1 [kgm] which is much greater than torque T2 [kgm] that can be exerted by the chuck of the drill head.

On drill head 20 of drilling machine 10 there is also a torque sensor/limiter system, which is electrically connected to the data processing unit and is capable of identifying and detecting, respectively, the torque value applied by the head chuck as the rod is being rotated and a torque threshold value which is reached at a predetermined tightening stage between two drilling rods or between the chuck itself and head 31 of a drilling rod 30.

Said secondary well 200 is commonly known as mouse hole, and is arranged alongside main well 100, sharing therewith the same orientation. Drilling machine 10 further comprises a drilling rod and casing handler 40, the task of which is to pick up drilling rods 30 or casings 30*a* from a container 50 and move them towards secondary well 200.

Handler 40 comprises a clamp 41 that can be opened or closed to clamp or release drilling rod 30 or casing 30*a*.

Figure 4:
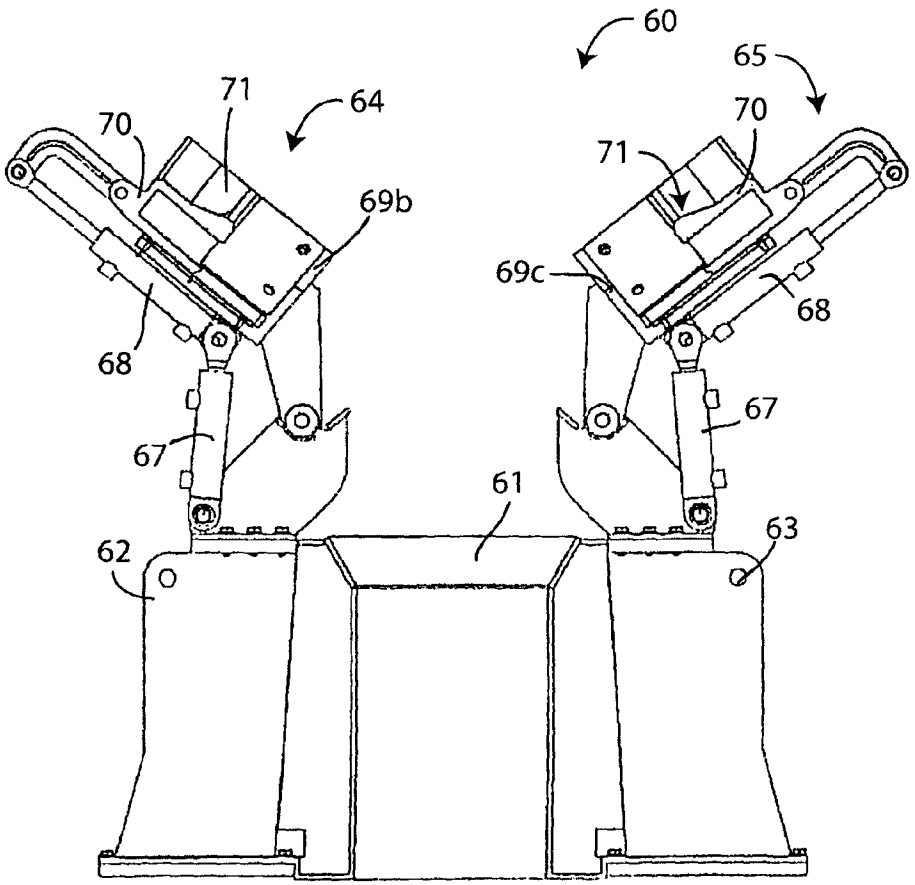
Figure 6:
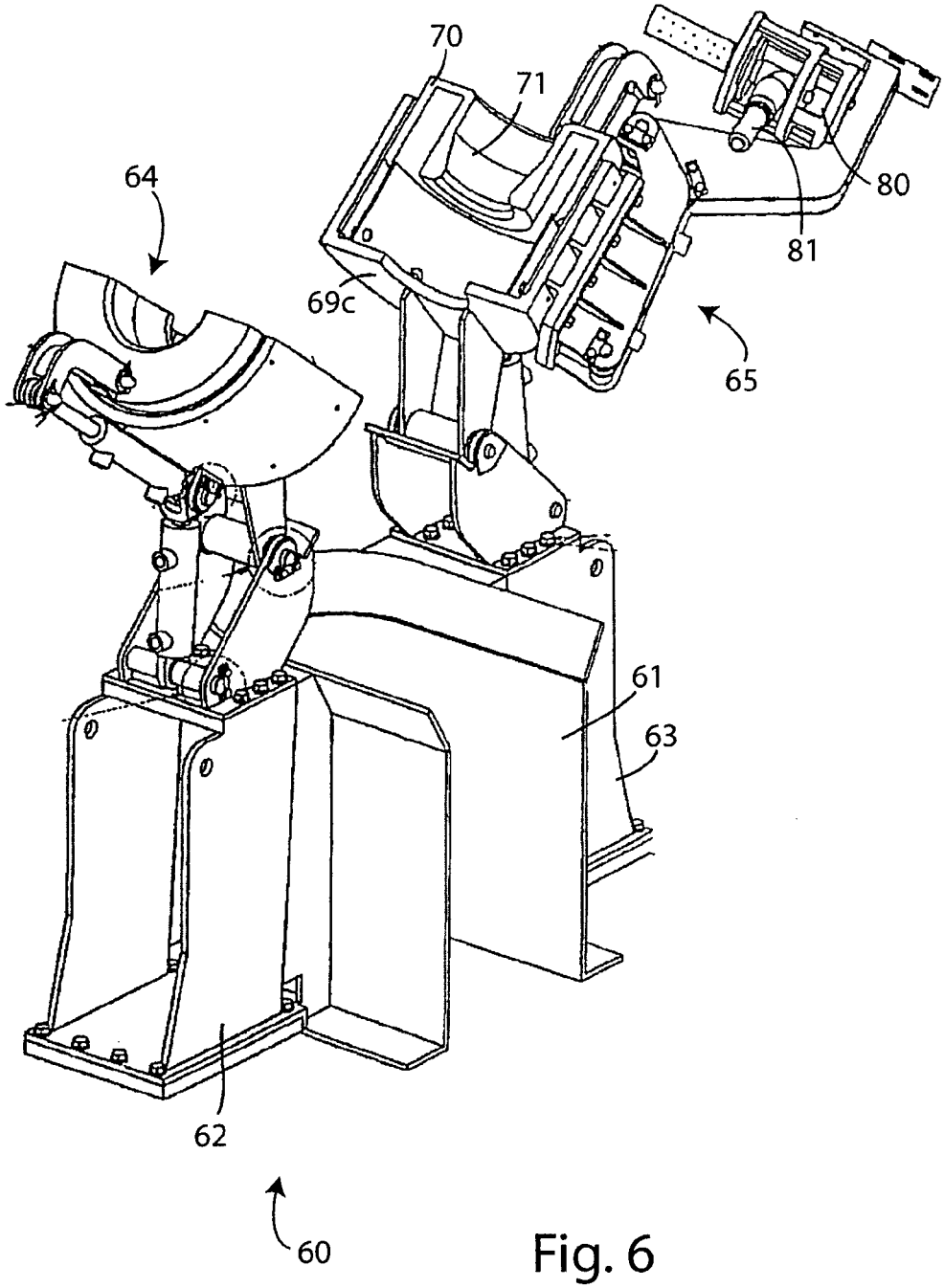
Figure 7:
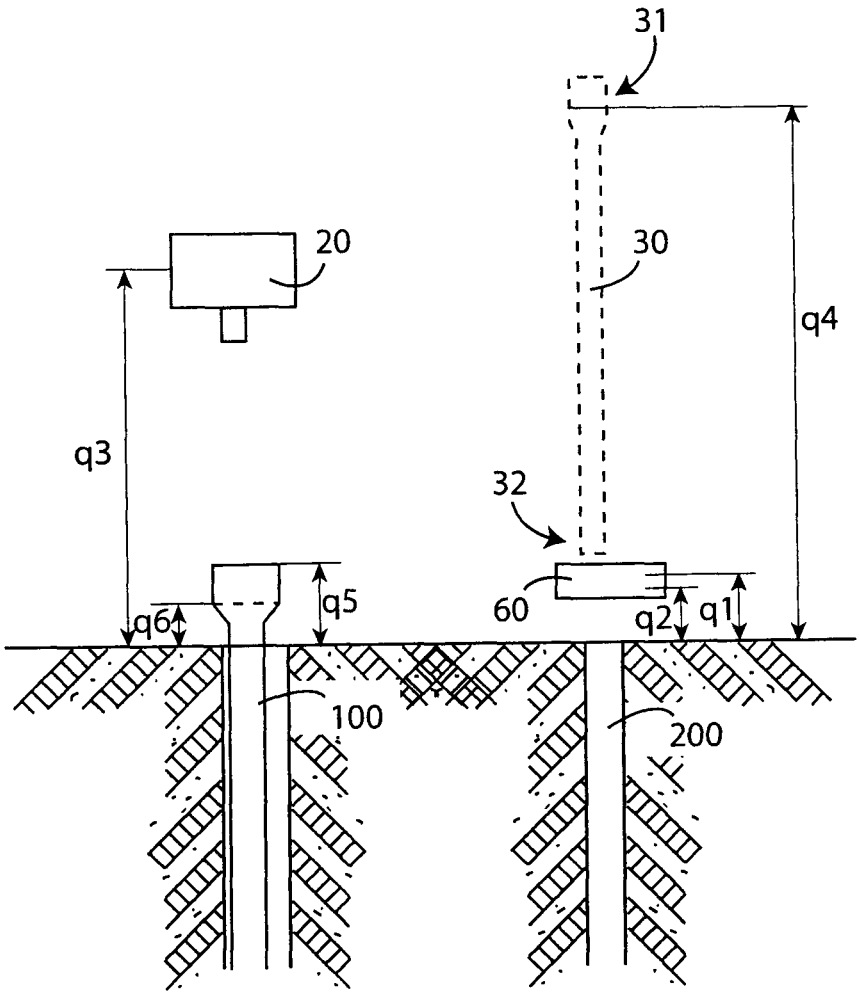
FIG. 7 shows a detail of the machine of FIG. 1, wherein a plurality of reference heights are given.

Above the level of the ground, lying on the same axis as secondary well 200, drilling machine 10 comprises a vice 60 which, as shown in more detail in FIG. 4, comprises a body 61 having a semicircular section which is open and elongated on one side to allow inserting drilling rod 30 or casing 30*a*. For this reason, the inside diameter of the semicircular section is greater that the diameter of drilling rod 30.

At the sides of body 61, a pair of support structures 62, 63 extend on which a pair of jaws 64, 65 are pivoted; said jaws rotate about an axis that, when in use, is orthogonal to the axis of drilling rod 30, once this has been inserted into the body.

Jaws 64, 65 are equipped with a pair of hydraulically controlled handling pistons 67, 68.

Jaws 64, 65 also have respective centering surfaces 69*b*, 69*c* having a semicircular cavity; once the jaws have closed, said centering surfaces 69*b*, 69*c* form together a circular-section hole which is barely greater than the diameter of drilling rod 30, and anyway smaller than the size of the section of body 61.

Figure 5:
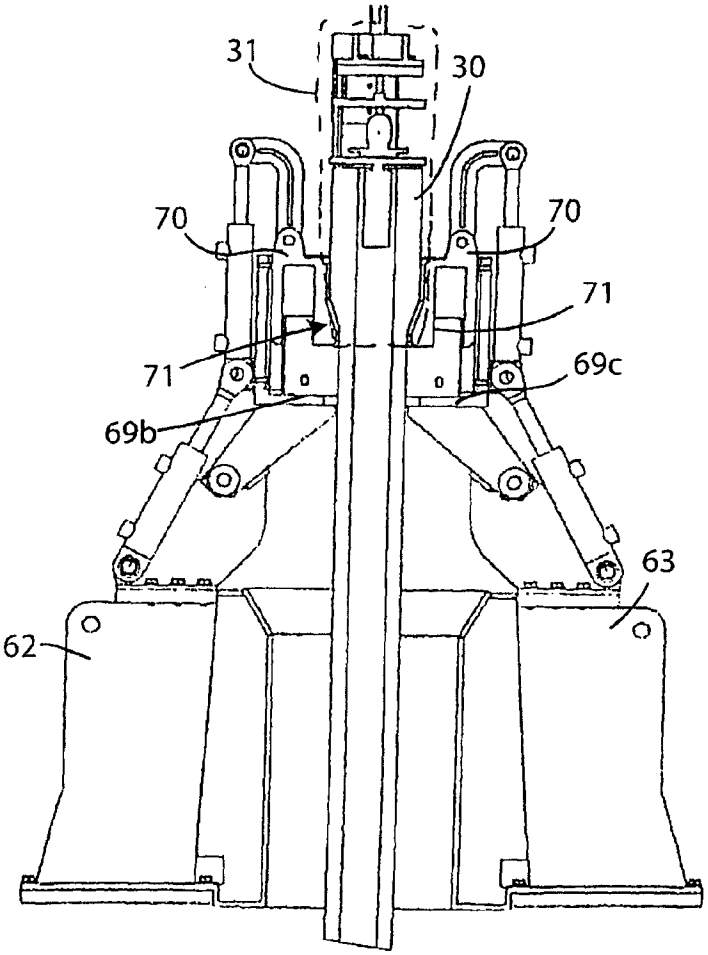
FIGS. 4-6 respectively show a perspective view and two sectional views of a drilling rod vice.

As shown in FIGS. 4 and 5, above centering surfaces 69*b*, 69*c*, but still on jaws 64, 65, there are also pressure detecting elements 70 capable of sensing when drilling rod 30 is resting in an idle position.

In particular, in fact, drilling rod 30 comprises a head 31 having a greater diameter than the remaining part of the rod; head 31 is radiused smoothly to the remaining part of the drill head, so that it has a truncated cone section resting on a pair of side surfaces 71 of the pressure detectors, thus allowing drilling rod 30 to remain suspended above secondary well 200.

Drilling machine 10 further comprises a data processing unit (not shown), which comprises memory means for storing the data about the position of drilling rod 30 and a plurality of data reception/transmission means for communicating with the various components of drilling machine 10, in particular with vice 60. Said data reception/transmission means may be either wired or wireless transceivers.

On one of two jaws 64 or 65 there is an automatic greater 80 fitted with a swivelling greasing device 81, which can be directed towards head 31 of drilling rod. Automatic greasing device 81 is equipped with a perforated metal sheet which allows grease to escape and which is susceptible to entering into the head of the drilling rod in order to grease the thread thereof. Automatic greater 80 is activated for a preset time upon a command issued by the data processing unit.

The first sub-method of inserting a drilling rod 30 or a casing 30*a* into main well 100 will now be described.

In the following description a plurality of reference heights will be given which, by convention, will refer to the drill floor.

It is assumed herein that a drilling rod 30 or a casing 30*a* is already present in secondary well 200, that vice 60 has open jaws 64, 65, and that a set of drilling rods 30 or casings 30*a* is connected to drill head 20 of drilling machine 10.

In a first step handler 40 moves the head of drilling rod 30 or casing 30*a* to a first height q1 corresponding to vice 60, and then descends bringing clamp 41 below the vice itself. At this point, handler 40 sends an enable signal to the data processing unit, which forwards it to jaws 64, 65, which then close. The correct position of clamp 41 is detected, for example, by a height sensor mounted thereon.

In a second step, when jaws 64, 65 are completely closed, handler 40 lowers further down, thereby further dropping drilling rod 30 or casing 30*a* into auxiliary well 200 until its weight is discharged onto side surfaces 71 of pressure detectors 70 (second height q2, lower than the first height).

As pressure sensor 70 (e.g. a limit switch) detects that drilling rod 30 is fully resting on side surfaces 71, it sends a support confirmation signal s2 to the data processing unit, which then transmits an opening command to clamp 41 of handler 40.

Next, in a third step, automatic greater 80 is positioned at head 31 of drilling rod 30 or casing 30*a*.

Subsequently, in a fourth step, drill pipe 30 or casing 30*a* is raised to the level of automatic greater 80, which at this point receives an activation command from the data processing unit for a predetermined time.

Meanwhile, in a fifth step, drill head 20 is still connected to a drilling rod 30 or casing 30*a* of the series of rods positioned at main well 100. It is therefore disconnected from preceding drill pipe 20 as follows.

First of all, in a sixth step, it is verified that the weight of drilling rod 30 in main well 100 is being discharged onto a plurality of support wedges.

Subsequently, drill head 20 is unscrewed by a power clamp 90, which is brought close to drilling rod 30 or casing 30*a* and then turns drill head 20 while holding drilling rod 30 or casing 30*a* through a pair of power vices.

The power vices, along with unscrewing clamp 90, are then moved to an idle position.

At this point, the drill head turns its own chuck in a first direction of rotation for a number of revolutions predetermined by a rotation command sent by the data processing unit.

At this point, in a seventh step, drill head 20 is raised to a third height q3—preferably higher than the first and second heights—and is then translated over secondary well 200.

Afterwards, in an eighth step, drill head 20 is lowered slowly towards first height q1 and, at the same time, it is turned at a predetermined speed stored in the data processing unit; in addition, a torque limiter is activated by the data processing unit.

During its descent, the chuck of drill head 20 meets the screw of head 31 of drilling rod 30, and is screwed thereinto until the torque sensor detects a torque value greater than a first threshold value t_h1, which is reached when the connection is fully tightened. This step is also applicable to the handling of casings 30*a*.

Of course, drill head 20 will arrive at first height q1 only when fully tightened.

As soon as the first threshold value is exceeded, in a ninth steps jaws 64, 65 of vice 60 open. At this point, drill head 20 is raised to a fourth height q4, higher than the three previous ones and sufficient to clear the bottom end of drilling rod 30 from any obstacles.

Subsequently, in a tenth step, drill head 20 is translated again over main well 100, and is then lowered to a fifth height q5, where the bottom end of drilling rod 30 or casing 30*a*, held by drill head 20—in particular by the chuck thereof—does not come in contact with the screw of head 31 of another drilling rod 30 or casing 30*a* previously driven into main well 100 (head 31 of this latter rod being at a sixth height q6).

For this reason, the difference between the fifth height and the sixth height substantially equals the length of the thread of the head of drilling rod 30.

During the tenth step, a stabilizer arm, not shown in the annexed drawings, clamps a bottom part of drilling rod 30 or casing 30*a* as soon as drill head 20 lies on the axis of the main well. The stabilizer arm is positioned lower than drill head 20, and mainly extends horizontally from the structure of the drilling machine until one of its ends, fitted with a prehension means, reaches a position near the axis of the main well.

This eliminates any oscillations of drilling rod 30 or casing 30*a*, which would be particularly dangerous because during its translational movement to/from main well 100 the rod or casing is only held by head 31.

The tenth step ends when the torque sensor sends a stop signal corresponding to the condition where the bottom end of drilling rod 30 or casing 30*a* is fully screwed into the thread of head 31 of the drilling rod already present in the wellbore. The stop signal corresponds to the achievement of a second torque threshold value t_h2.

In the next eleventh step, power clamp 90 is moved towards the last drilling rod 30 inserted in the series in the main well in order to complete the tightening process by applying a torque greater than that previously applied. As soon as the tightening process is completed, the power vice is placed again into a parking position.

In a twelfth step, also the stabilizer arm is retracted to a position remote from the axis of the main well, so that the series of rods can be lowered deeper into the main well.

The lowering of drilling rods 30 or casings 30*a* takes place for a length equal to the length of the last drilling rod 30 or casing 30*a* driven in the well, so that head 31 thereof returns to a level corresponding to sixth height q6.

During eleventh step, and in particular before drilling rods 30 or casings 30*a* start being lowered, a plurality of support wedges are removed; to do so, the entire set of drilling rods 30 or casings 30*a* in main well 100 is raised by a raise height qr sufficient to allow the removal of the support wedges.

When the lowering process is over, the support wedges are inserted again to support drilling rods 30.

At this point, the head of last drilling rod 30 or casing 30*a* is at the sixth height, and the power vices intervene again to allow unscrewing head 31 from the chuck, which head, after being first only partially unscrewed by means of the power vices, is then fully unscrewed through a simple rotation of the chuck itself with respect to the rod.

During all of the above-described steps, the sequence of the rods or casings driven into main well 100 is saved into a memory area of the data processing unit, so that, should these have to be extracted, the number of rods still present in main well 100 will always be known during the removal process.

Therefore, when a new drilling rod 100 is picked up from the rod container, the number of rods driven into main well 100 is incremented; vice versa, during the extraction process said number is decremented.

The second sub-method of extracting drilling rods from main well 100 substantially takes place in the reverse order than previously described.

It is assumed herein that a plurality of drilling rods 30 are resting on support wedges in main well 100, and that the chuck of drill head 20 is screwed into corresponding last head 31 of drilling rod 30.

Initially, in a first step, a plurality of support wedges are removed; to do so, the entire set of drilling rods 30 in main well 100 is raised by a raise height qr sufficient to allow the removal of the support wedges.

Subsequently, in a second step, drilling rods 30 are extracted by a length equal to the length of last drilling rod 30 inserted in main well 100, so that head 31 thereof is again at a level corresponding to sixth height q6.

In a third step, power clamp 90 is moved towards last drilling rod 30 inserted in the series in the main well in order to start unscrewing the foot of last drilling rod 30 from head 31 of the penultimate drilling rod inserted in main well 100. When this initial unscrewing is complete, power clamp 90 is placed again into a parking position.

At this point, in a fourth step the foot of last drilling rod 30 is fully unscrewed from head 31 of the penultimate drilling rod inserted in main well 100. The unscrewing process is stopped through a torque sensor.

In a fifth step, a clamp stabilizer arm is operated to act upon a bottom part of drilling rod 30 for the purpose of limiting its horizontal movement. This prevents drilling rod 30 from oscillating.

In a sixth step, the drilling rod is raised to a fourth height q4, higher than the fifth and sixth heights, and anyway sufficient to clear the bottom end of drilling rods 30 from any obstacles.

In a seventh step, drill head 20 is translated again over secondary well 200, so that it can then be lowered to first height q1, where vice 60 is activated by the data processing unit and jaws 64, 65 close.

Next, in an eighth step, when jaws 64, 65 are fully closed, the drilling rod is lowered further down until side surfaces 71 of pressure detectors 70 indicate that the rod weight is being completely discharged onto them. In this case as well, the data processing unit is sent support confirmation signal s2.

In a ninth step, the drill head is unscrewed from head 31 of the drilling rod through the chuck and is then raised. A support confirmation signal s2 is also sent to the data processing unit, which then issues a command for activating handler 40 in order to pick up drilling rod 30 from secondary well 200 and transfer it into the container.

At this point, in a tenth step, handler 40 is positioned below he vice 60 and then slightly raises drilling rod 30 in secondary well 200 so as to relieve its weight from pressure sensors 70.

As the pressure is relieved, in an eleventh step pressure sensor 70 sends an enable signal to the data processing unit, which then opens jaws 64, 65 of vice 60.

At this point, the head of drilling rod 30 in secondary well 200 has returned to height q1.

Then, in a twelfth step, drilling rod 30, firmly held by clamp 41 of handler 40, is extracted from vice 60 and is placed into its container. At the same time, the number of pipes in main well 100 stored in the memory of the data processing unit is decremented.

In addition to handling drilling rods having a predetermined length to and from main well 100, the method and the drilling machine according to the present invention can also measure the actual length of the drilling rod being picked up, so that the machine can also operate automatically with drilling rods 30 of variable length.

In such a case, the drilling machine further comprises a first means for reading a first length height q11, which means is electrically connected to and activated by the data processing unit when clamp 41 of handler 40 picks up drilling rod 30 from the auxiliary well, a meter for measuring a distance d travelled as drill head 20 is being raised once drilling rod 30 has been screwed to the chuck, and a rod presence sensor, arranged on vice 60, which is electrically connected to the data processing unit and sends to the latter a signal indicating the interruption of the presence of the rod in vice 60. When the data processing unit receives said signal, it detects, alternatively or in combination, a second length height q12 and the distance d.

If distance d is calculated, the calculation begins from the moment when drill head 20 starts rising (i.e. from the first length height q11) and ends when the data processing unit receives the signal indicating the interruption of the presence of the rod in vice 60.

The data processing unit, after having stored:

a) first length height q11; and b) second length height q12 or, alternatively or simultaneously, distance d;

can identify the exact length of drilling rod 30 or casing 30*a* being picked up, and can thus save it into its own memory.

For this reason, the drilling machine and the method according to the present invention also allow for the use of rods of different lengths.

It is also apparent that a computer program is associated with the data processing unit for storing steps 1000-1011; 2000-2011 corresponding to the first and second sub-methods as described above. Said computer program may be recorded on a fixed or removable memory medium included in the data processing unit (e.g. a floppy disk, a CD, a DVD, a flash memory, a portable drive or any other removable media, with no limitations whatsoever), to be then loaded into the memory of said data processing unit in order to execute the method according to the present invention.

The advantages of the method according to the present invention are apparent in the light of the above description. In particular, it allows for a fully automatic management of the steps of picking up drilling rods from a container, placing them into an auxiliary secondary well, and driving them into the main well in sequence; also, the above-described method allows executing the reverse operation, i.e. extracting drilling rods, in a fully automated manner.

It follows that the user is no longer charged with the task of directly managing the raising and moving of the drill head, nor of manually controlling the power vices and clamps; all these operations are carried out by an automatic system, and the user only has to issue a command for driving in or extracting the drilling rods.

Therefore, not only has the operator or user at the controls less work to do, he is also kept away from the dangerous area around the well head; furthermore, by means of the method according to the present invention it is possible to grease the threads on the head and foot of drilling rods 30 evenly with a predetermined quantity of grease.

In addition, the method as described herein may also be used for handling casings; it follows that the machine implementing the method according to the present invention performs a double function: it allows driving into a well both drilling rods 30 and casings 30*a* through a single head assembly (top drive 20) without needing any adaptations other than using a properly sized tool, the diameter of casing 30*a* being significantly greater than that of drilling rod 30.

Furthermore, the use of a top-drive type drill head 20 enhances the flexibility of the excavation equipment, which can thus carry out two distinct operations characterized by an identical movement (handling drilling rods 30 and casings 30*a*), while at the same time improving the safety of the handling process over the prior art.

In fact, both casings 30*a* and the drilling rods are kept in the vertical position, thus reducing the flexing torques that may be generated at the joints during the traditional process of picking up a drilling rod inclined relative to the vertical.

In addition, drill head 20 can limit the damage suffered in the event of a sudden blow-out, in that it is connected inside the drilling rods and the casings. In other words, drill head 20 acts as a blow-out prevention valve.

The method described so far may be subject to many variations, modifications or additions obvious to those skilled in the art without however departing from the protection scope set out in the appended claims.

It is for example apparent that, although the above-described method refers to a rod which is temporarily placed into a secondary well 200, said secondary well may likewise be replaced by any other auxiliary retaining means; in other words, the rod may also be held by a retaining means wholly above ground. In such a case, it will suffice to move vice 60 to a sufficiently high level to prevent the rod foot from touching the ground.

The invention claimed is:

1. Method for automatic handling of drilling rods and tubular wellbore casing elements, comprising:

handling at least one drilling rod or a tubular wellbore casing element by a handler designed for simultaneously clamping and moving said drilling rod or said tubular wellbore casing element, wherein said handler moves said drilling rod or said tubular wellbore casing element from auxiliary retaining means to a main well; wherein said handling step takes place automatically and is controlled by a data processing unit, automatically handling of a drill head fitted with a chuck configured to being screwed to said drilling rod or to said tubular wellbore casing element; said automatic handling occurring among a plurality of heights stored in said data processing unit:

determining discharge of the weight of said drilling rod or said tubular wellbore casing element onto a pressure detector of a vice supporting said drilling rod or said tubular wellbore casing element; said vice being positioned above said auxiliary retaining means; said determining comprising transmission of a support confirmation signal to said data processing unit.

2. The method according to claim 1, comprising a step of determining a length of said drilling rod or said tubular wellbore casing element; said determination step comprising reading a first length height through height reading means electrically connected to said data processing unit.

3. The method according to claim 2, wherein said determination step further comprises a step of determining a distance travelled by said drill head during an extraction of said drilling rod or said tubular wellbore casing element from said auxiliary retaining means.

4. The method according to claim 3, wherein said distance is calculated starting from a point where said drill head starts moving and ends when a presence sensor sends to said data processing unit a signal indicating an interruption of the presence of said drilling rod or said tubular wellbore casing element.

5. The method according to claim 2, wherein said determination step further comprises measuring a second length height.

6. The method according to claim 5, wherein said second length height is determined when a presence sensor sends to said data processing unit a signal indicating an interruption of the presence of said drilling rod or said tubular wellbore casing element (30*a*).

7. The method according to claim 1, further comprising a first step of positioning said handler carrying said drilling rod or said tubular wellbore casing element at a first height corresponding to a vice positioned above said auxiliary retaining means.

8. The method according to claim 7, wherein said first step further comprises transmission of an enable signal from said handler to said data processing unit to open or close a pair of jaws of said vice.

9. The method according to claim 1, comprising at least one step selected between a step of unscrewing and a step of screwing a chuck from/to said drill head; said step comprising determination of a torque threshold value.

10. The method according to claim 1, wherein said auxiliary retaining means is a secondary well positioned alongside said main well.

11. The method according to claim 1, further comprising a step of greasing at least one thread at one end of said drilling rod; said greasing step being carried out by automatic greasing means.

12. The method according to claim 11, wherein said automatic greasing means receives an activation command from the data processing unit for a predetermined time.

13. Memory medium configured for loading into memory of at least one electronic computer and which comprises portions of software code for executing the method according to claim 1.

14. Excavation equipment for driving a plurality of drilling rods into a main well; said excavation equipment comprising:

a drill head fitted with a chuck configured to be screwed to or unscrewed from said drilling rod; wherein said drill head is engageable with a plurality of tubular wellbore casing elements, configured to be lowered into said main well as casing elements;

a data processing unit for automatically controlling handling of said drilling rods and said tubular wellbore casing elements;

a vice supporting said drilling rod or said tubular wellbore casing elements; said vice being positioned above auxiliary retaining means;

a pressure detector determining discharge weight of said drilling rod or said tubular wellbore casing elements, wherein said pressure detector transmits a support confirmation signal to said data processing unit.

* * * * *